US005313890A

United States Patent [19]

Cuadros

[11] Patent Number: 5,313,890

[45] Date of Patent: May 24, 1994

[54] FRAGMENTATION WARHEAD DEVICE

[75] Inventor: Jaime H. Cuadros, Hacienda Heights, Calif.

[73] Assignee: Hughes Missile Systems Company, Los Angeles, Calif.

[21] Appl. No.: 692,847

[22] Filed: Apr. 29, 1991

[51] Int. Cl.[5] ..... F42B 12/32

[52] U.S. Cl. ..... 102/496; 102/393; 102/489

[58] Field of Search ..... 102/393, 489, 494–497

[56] References Cited

U.S. PATENT DOCUMENTS

| | | | |
|---|---|---|---|
| 19,410 | 1/1835 | McCloud | 102/6 |
| 1,543,850 | 6/1925 | Holderer . | |
| 1,543,851 | 6/1925 | Holderer . | |
| 3,489,088 | 1/1970 | Von Ballmoos et al. | 102/61 |
| 3,491,694 | 1/1970 | Fountain | 102/67 |
| 3,635,163 | 1/1972 | Philipchuk | 102/64 |
| 3,677,183 | 7/1972 | Talley | 102/494 |
| 4,305,333 | 12/1981 | Altenau et al. | 102/306 |
| 4,492,165 | 1/1985 | Marz | 102/313 |
| 4,493,264 | 1/1985 | Jameson | 102/491 |
| 4,807,534 | 2/1989 | Vockensperger et al. | 102/489 |
| 4,982,668 | 1/1991 | Bender et al. | 102/495 |
| 5,005,481 | 4/1991 | Schneider et al. | 102/489 |

FOREIGN PATENT DOCUMENTS

| | | | |
|---|---|---|---|
| 3026159 | 8/1982 | Fed. Rep. of Germany | 102/489 |

*Primary Examiner*—Harold J. Tudor

[57] ABSTRACT

A fragmentation warhead device has a fabric liner woven from high-strength fibers located between the explosive charge and the fragments. The liner has a maximum diameter larger than that of the overall warhead, and is compressed to fit closely around the explosive charge prior to detonation by forming one or more longitudinal folds or pleats in the fabric. The fragments are retained against the outer surface of the sleeve prior to detonation by a suitable outer enclosure, and may be located between adjacent pleats in the fabric. On detonation, the sleeve expands to contain the gases produced by the explosion for an extended period of time.

9 Claims, 2 Drawing Sheets

FRAGMENTATION WARHEAD DEVICE

BACKGROUND OF THE INVENTION

The present invention relates to warheads for missiles and projectiles which are designed to launch preformed fragments at high velocity to cause damage on impact on a target.

Conventional fragmentation warheads include an outer case holding the fragments against an internal explosive charge. Upon detonation, the gases generated by the explosion expand and exert pressure on the fragments, increasing the hoop diameter of the warhead assembly. After some expansion has taken place, the case holding the fragments ruptures, and gases vent through the resultant gaps, reducing the pressure exerted on the fragments and terminating their acceleration. Thus, the available energy is limited.

In an attempt to increase the available energy, a soft ductile metal liner has been used to separate the fragments from the explosive charge. The purpose of this liner is to expand, containing the gases for a longer time before the outer case ruptures and allows venting. This delay allows a larger percentage of the accelerating energy of the explosion to be coupled to the fragments, increasing their velocity.

SUMMARY OF THE INVENTION

It is an object of this invention to provide a new and improved fragmentation warhead device with increased energy coupled to the propelled fragments after detonation.

According to the present invention, a fragmentation warhead device is provided which comprises a central core of explosive material, a sleeve of fabric material surrounding the central core, the sleeve having larger cross-sectional dimensions than the core and having at least one fold extending along its length for reducing its internal dimensions to fit against the outer surface of the core, a plurality of fragments Positioned around the outside of the sleeve, and a retainer device for retaining the fragments against the sleeve prior to detonation.

The sleeve preferably has an expanded diameter of 1.5 to 2.5 times that of the basic warhead, and is of a fabric material woven into a cylindrical form from high-strength fibers, such as Kevlar, S-Glass, E-Glass or similar fibers. Preferably, the sleeve has a series of spaced longitudinal outwardly projecting pleats extending along its length , with the fragments retained in the gaps between adjacent pleats via a suitable outer casing or enclosure such as a tubular Metal or plastic casing or via tape spirally wound around the outside of the assembled fragments and sleeve. The sleeve may comprise single or multiple fabric layers, depending on the nature of the fragments, with multiple layers providing additional flash protection from the detonation.

This allows a soft launch of fragments at relatively high velocity, with the relatively soft fabric liner protecting the fragments and allowing them to be launched with little or no launch damage. This will permit preformed fragments of solid material to be launched, as well as composite fragments having internal voids filled with reactive fluids. The fabric liner softens the launch and allows the fragments to be propelled in one piece, without rupturing. The reactive fluid filling the internal spaces in the fragments will enhance damage at the target on impact. Thus, this arrangement allows such fragments to be launched in one piece more reliably than in the past, where they have often been fractured on detonation of the explosive charge. The launch may be further softened by inserting cushioning materials in the interstitial spaces between the folds, and also in the weave of the fabric material itself.

When the internal core or explosive charge is detonated, the fabric liner or sleeve will first expand to accommodate the resultant gases, containing the gases until the sleeve ruptures, propelling the fragments outwardly as a result of the accelerating energy of the expanding gases. The effect of delaying the venting of the expanding gases in this way is to is couple a larger percentage of the accelerating energy to the fragments, increasing their velocity and thus increasing their range and the resultant damage on impact.

The fabric sleeve or liner also produces a softer launch, cushioning the fragments against the explosion. The soft launch may be enhanced by using multiple fabric layers, and by use of a lower energy explosive. The same fragment launch velocity can be achieved with the expandable liner as would be produced without the liner by a high energy explosive. This further enhances the soft launch characteristics reducing risk of damage to the fragments.

BRIEF DESCRIPTION OF THE DRAWINGS

The present invention will be better understood with reference to the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1A:
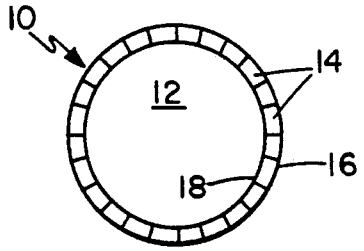
FIG. 1 A PRIOR ART
FIG. 1A is a typical cross-section of a conventional fragmentary warhead.
Figure 1B:
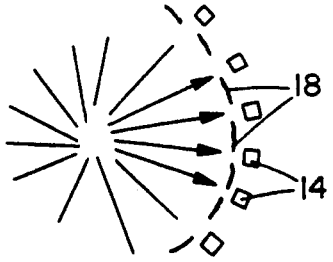
FIG. 1 B PRIOR ART
FIG. 1B illustrates the warhead in the early explosive stage with the fragments separated.

Conventional fragmentation warheads 10, as illustrated in FIG. 1A, basically comprise an internal explosive charge 12, fragments 14 surrounding the explosive, and an outer casing 16 holding the fragments. Fragmentation energy has been increased in this conventional arrangement by placing a metal liner 18 between the explosive 12 and the fragments 14. The liner expands and contains the gases for a longer time before venting, with an expansion of 1.2 to 1.5 from the original circumference being achieved before rupture. When the liner ruptures, as illustrated in FIG. 1B, the gases vent through the gaps and the pressure exerted on the fragments is reduced.

In contrast, the improved fragmentation warhead device 20 according to a preferred embodiment of the present invention, as illustrated in FIGS. 2 to 5, increases the time in which the gases can be contained and allows a much larger expansion ratio, as will be explained in more detail below.

The fragmentation warhead device 20 basically comprises a cylindrical inner core or explosive charge 22, a sleeve or liner 24 of high-strength fabric material surrounding the charge, and a plurality of shaped fragments 26 secured around the outside of the liner 24 via a suitable retainer, such as an outer casing 28 as illustrated. The outer casing may comprise a cylindrical tube or container of solid material, or simply an adhesive tape wound around the outside of the fragments to retain them in place, dependent on the type of projectile or missile carrying the warhead. If necessary, the fragments may also be adhesively secured to the sleeve or, liner 24.

Figure 3:
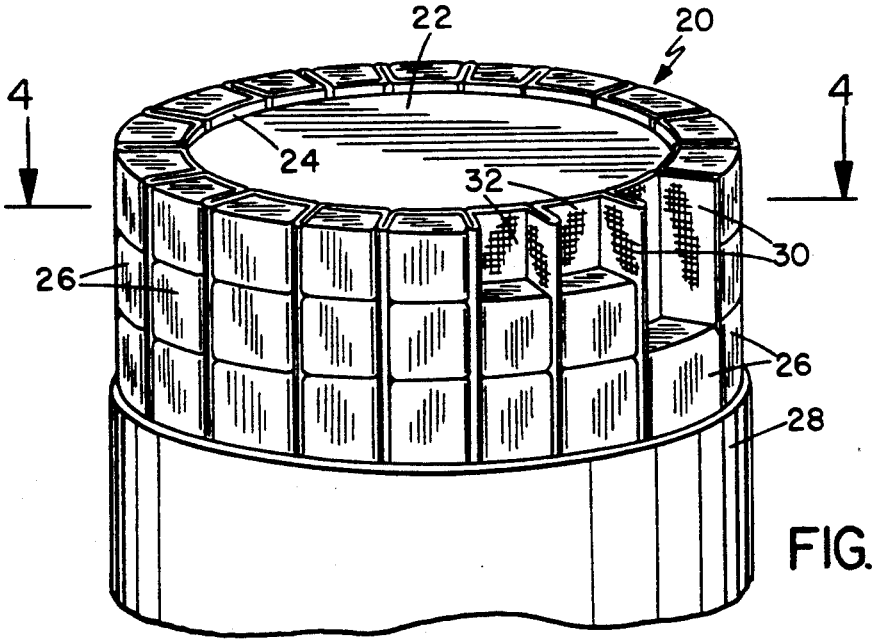
FIG. 3 is a perspective view of one end of the improved warhead.
Figure 4:
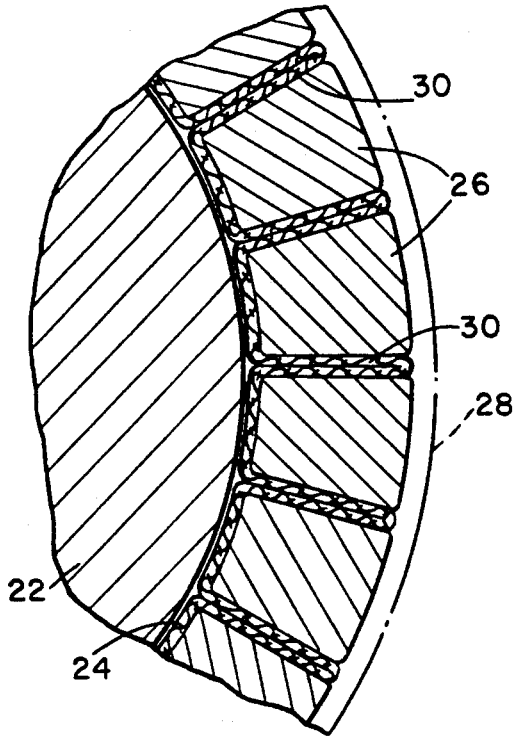
FIG. 4 is an enlarged sectional view taken on line 4—4 of FIG. 3.

The diameter of the sleeve 24 is larger than that of the assembled warhead, and is preferably 1.5 to 2.5 times larger than the warhead diameter. The sleeve has a plurality of spaced, outwardly directed longitudinal pleats or folds 30 formed around its periphery, as best illustrated in FIGS. 3 and 4, to reduce its inner diameter to fit against the inner core 22. The fragments 26 are located in the spaces or longitudinal channels 32 between adjacent pleats, and have a thickness substantially equal to the depth of the pleats so that their outer surfaces are substantially flush with the outer ends of the pleats, as best illustrated in FIG. 4. Although the fabric is folded to form a series of outwardly directed pleats in the illustrated embodiment, it may alternatively be pleated or folded in other ways, for different purposes, for example only a single fold may be formed which is laid flat against the outer or inner side of the sleeve to form a generally cylindrical arrangement. Additionally, although a single layer of fabric is used in the illustrated embodiment, several layers of fabric material may be used to form the sleeve in alternative arrangements to increase strength and also to provide the externally mounted fragments with additional flash protection on detonation.

The fabric sleeve is preferably woven in a cylindrical form to match the desired warhead body form and is made of high-strength fibers such as Kevlar or fiberglass such as S-Glass or E-Glass, or similar fibers. The hoop diameter of the woven liner is made 1.5 to 2.5 times the diameter of the plain warhead.

Figure 2A:
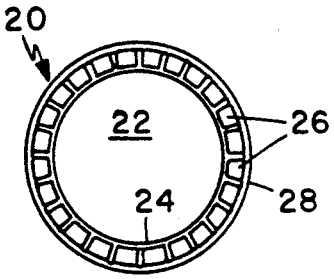
FIG. 2A is a cross-section of an improved warhead according to an embodiment of the present invention.
Figure 2B:
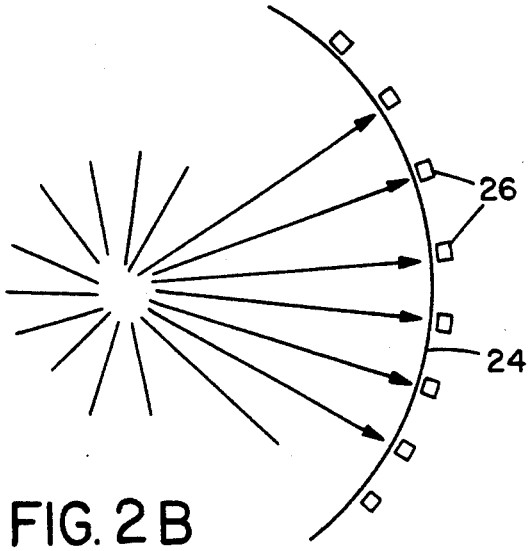
FIG. 2B illustrates the improved warhead in an explosive stage with the fragments still being expanded by the liner.
Figure 5:
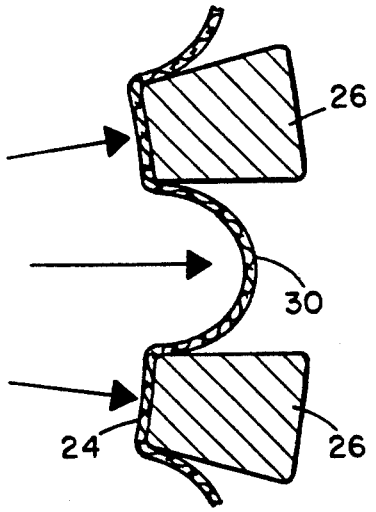
FIG. 5 illustrates the structure of FIG. 4 in an initial expansion age.

FIGS. 2A and 2B illustrate schematically the effect of the woven, pleated liner on detonation. On detonation, the sleeve will expand to its full diameter before rupturing and allowing the expanding gases to vent, delaying the venting of the expanding gases significantly, as can be seen by a comparison of FIG. 2B with FIG. 1B. FIG. 5 illustrates the liner in a partially expanded state while in FIG. 2B it is shown fully expanded prior to venting. Thus, the gases are contained for a significantly longer time before venting, allowing the explosive to propel the fragments to a higher velocity, or alternatively allowing a lower energy explosive to be used to obtain a velocity similar to that obtainable in a conventional warhead arrangement as in FIG. 1 with higher energy explosives. Use of a lower energy explosive is desirable with fragments which are susceptible to damage on launch, such as composite fragments.

In the embodiment illustrated in FIGS. 2 to 5, the fragments are relatively small cubical elements of solid material, such as metal, arranged in columns to extend along the gaps or spaces between adjacent longitudinal pleats. The fabric sleeve contains the gases on detonation for an extended period while it expands to its maximum diameter, as illustrated in FIG. 2B, increasing the fragment launch velocity. However, the fragments need not necessarily be cubical, but may alternatively comprise long, rectangular fragments, for example. Additionally, the fragments may be hollow or have internal voids filled with reactive chemicals in alternative arrangements to enhance the damage at the target after impact. These types of composite fragments have often been fractured in the past when launched explosively in the conventional manner. The fabric liner or sleeve of this invention should soften the launch and allow the fragments to be propelled in one piece.

Figure 6:
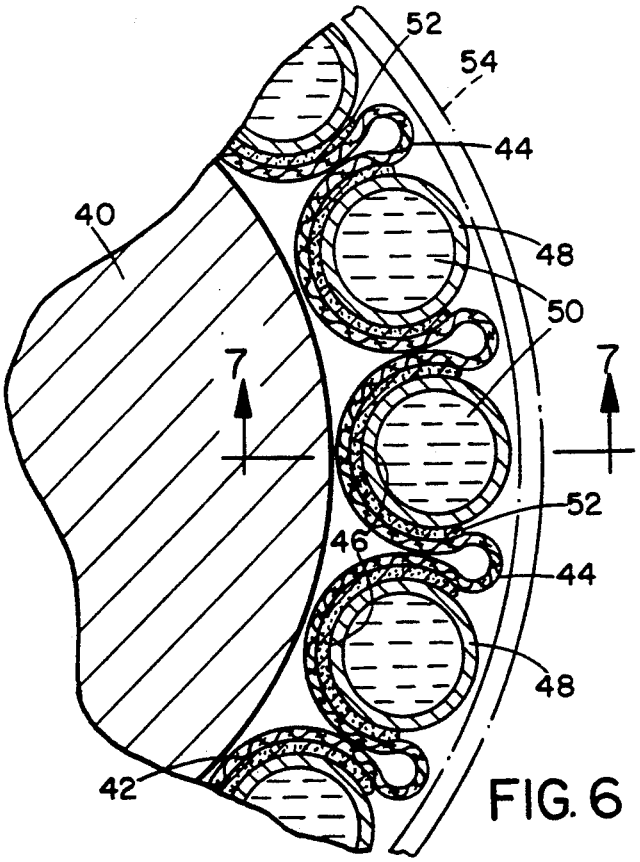
FIG. 6 is a view similar to FIG. 3, showing an alternative fragment and support system.
Figure 7:
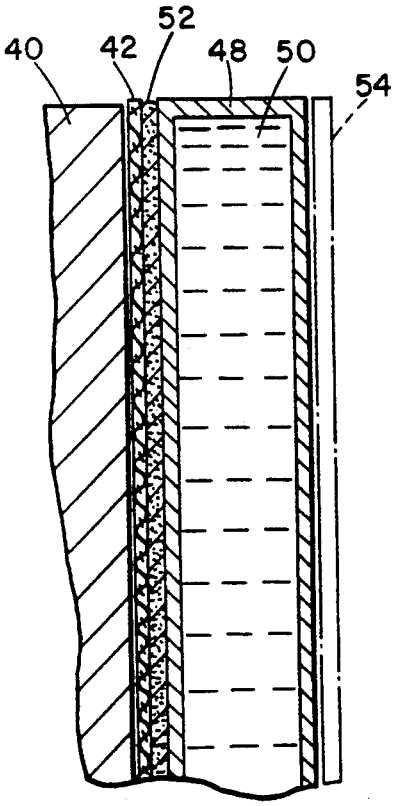
FIG. 7 is a sectional view taken on line 7—7 of FIG. 6.

FIGS. 6 and 7 illustrate a modified embodiment of the invention in which the fragments are filled with a suitable reactive chemical. In this embodiment, a central explosive core 40 is surrounded by a fabric sleeve 42 of larger diameter than the core, preferably 1.5 to 2.5 times the warhead diameter when fully expanded. The sleeve is pleated to form rounded folds or pleats 44 with part cylindrical, rounded grooves or indents 46 between adjacent pleats to receive elongate, cylindrical fragments 48 which extend along the length of the sleeve. Alternatively, the fragments 48 may be rectangular or of other shapes. The fragments are hollow and contain reactive liquid 50. A cushioning or padding layer or member 52 is preferably located between each fragment 48 and the underlying portions of sleeve 42, and the entire assembly is enclosed in a suitable outer casing 54. The padding layer may be of ceramic powder material, for example, and ceramic powder may also be inserted in the interstitial spaces in the woven material of the sleeve itself for additional cushioning. This will also act to strengthen the sleeve. The material of sleeve will be of the same type as in the first embodiment.

With this arrangement, the fragments 48 are protected from the explosive on initial detonation by the fabric liner and cushioning or padding layer, reducing the risk of damage or fracturing of the fragments on launch. A relatively low energy explosive will provide additional protection and "softening" of the launch, if necessary. This allows composite fragments, in other words fragments having internal voids filled with reactive fluids, to be launched with little or no launch damage.

The fragmentation warhead devices described above allow the launching of preformed fragments with a 10 to 20% increase in velocity over prior art fragmentation devices. Additionally, the expandable fabric sleeve stretches the acceleration period prior to venting of the gases produced by the explosion, by containing the gases while the sleeve expands to its maximum diameter. This delayed venting softens the launch shock and reduces the risk of damage to the preformed fragments, allowing launch of solid fragments or composite fragments having voids filled with reactive fluids.

Although some preferred embodiments of the invention have been described above by way of example only, it will be understood by those skilled in the field that modifications may be made to the disclosed embodiments without departing from the scope of the invention, which is defined by the appended claims.

I claim:

1. A fragmentation warhead device, comprising:

a central cylindrical core comprising an explosive charge;

a sleeve of fabric material surrounding the cylindrical core, the sleeve having larger cross-sectional dimensions than the core and having an inner cylindrical surface fitting closely around the outer surface of the central core, and a series of spaced, radially outwardly directed pleats formed at spaced intervals around the periphery of said cylindrical surface to define a plurality of spaced, longitudinally extending channels between adjacent pairs of pleats, each pleat comprising a double fold of material having inner faces with no intervening material between the faces;

a plurality of preformed fragments positioned in said channels between adjacent pleats around the outside of the sleeve; and retaining means for retaining the fragments against the sleeve prior to detonation of the explosive charge.

2. The device as claimed in claim 1, wherein the sleeve is cylindrical and has a maximum diameter of 1.5 to 2.5 times that of the warhead prior to detonation.

3. The device as claimed in claim 1, wherein the fragments are of solid material.

4. The device as claimed in claim 1, wherein the fragments have internal voids filled with reactive fluid.

5. The device as claimed in claim 4, including a cushioning layer between each fragment and the underlying portion of the sleeve.

6. The device as claimed in claim 1, wherein the fragments are elongate members extending along the length of the sleeve between adjacent pleats.

7. The device as claimed in claim 1, wherein the fabric material is of woven high-strength fibers.

8. The device as claimed in claim 1, wherein the pleats are flat folds and the fragments comprise generally rectangular blocks for fitting in the channels between adjacent pleats, the blocks having outer faces substantially flush with the outer folded ends of the pleats to define a substantially cylindrical and continuous outer surface.

9. The device as claimed in claim 8, wherein a plurality of blocks are located along the length of each channel.

* * * * *